United States Patent [19]

Trogan

[11] Patent Number: 4,765,604

[45] Date of Patent: Aug. 23, 1988

[54] RESILIENT CREASER

[75] Inventor: John F. Trogan, Ashland, Wis.

[73] Assignee: C. G. Bretting Manufacturing Company, Ashland, Wis.

[21] Appl. No.: 39,659

[22] Filed: Apr. 17, 1987

[51] Int. Cl.[4] ..... B41L 1/32

[52] U.S. Cl. ..... 270/39; 493/371; 493/430

[58] Field of Search ..... 270/39; 493/351, 354, 493/355, 361, 363, 366, 367, 370, 371, 396, 397, 399, 415, 428–430, 407, 454, 464

[56] References Cited

U.S. PATENT DOCUMENTS

| | | | |
|---|---|---|---|
| 225,506 | 3/1880 | Chambers, Jr. et al. | 493/429 |
| 1,015,580 | 1/1912 | Nichols | 493/399 |
| 1,228,835 | 6/1917 | Schuchart | 270/39 |
| 1,502,333 | 7/1924 | Braunstein | 270/39 |
| 2,070,324 | 2/1937 | Tornberg | 493/370 |
| 2,092,952 | 9/1937 | Campbell | 270/39 |
| 3,124,349 | 3/1964 | Huffman | 493/430 |
| 3,163,413 | 12/1964 | Franke et al. | 270/39 |
| 3,314,340 | 4/1967 | Bishop | 493/370 |
| 3,572,681 | 3/1971 | Nystrand | 270/39 |
| 4,070,014 | 1/1978 | Takahashi | 270/39 |
| 4,254,947 | 3/1981 | Trogan | 270/39 |
| 4,289,492 | 9/1981 | Simpson | 493/371 |
| 4,332,583 | 1/1982 | Stemmler et al. | 493/430 |
| 4,494,741 | 1/1985 | Fischer et al. | 270/39 |

FOREIGN PATENT DOCUMENTS

| | | | |
|---|---|---|---|
| 396273 | 8/1933 | United Kingdom | 270/39 |
| 1060865 | 3/1967 | United Kingdom | 493/429 |
| 197708 | 9/1977 | U.S.S.R. | 493/428 |

*Primary Examiner*—Eugene H. Eickholt
*Attorney, Agent, or Firm*—Faegre & Benson

[57] ABSTRACT

This invention relates to a paper interfolding machine of the type having first and second folding rolls mounted adjacent each other for rotation about parallel axes with porous tissue paper carried by each roll. A wedge-shaped protrusion on a first folding roll and a mating recess on a second folding roll is provided. A resilient member filling at least a portion of the mating recess forms an elastic anvil which is deformed by the protrusion received in the recess to crease a sheet of paper received in the nip between the rolls. Vacuum ports on the second folding roll are used to selectively adhere the sheet to the second roll during creasing.

6 Claims, 1 Drawing Sheet

RESILIENT CREASER

BACKGROUND OF THE INVENTION

In the past, numerous attempts have been made to provide simple and low-cost creasing mechanisms for paper sheet interfolding machinery. Such prior art approaches are exemplified by the mechanical approach disclosed in my U.S. Pat. No. 4,270,744 entitled TUCKERS ON MECHANICAL FOLDING ROLLS and my U.S. Pat. No. 4,475,730 entitled APPARATUS FOR FOLDING AND STACKING PAPER PRODUCTS, the disclosures of which are expressly incorporated herein by reference. Mechanical folding rolls of mechanical tuckers and vices do not work well on soft porous tissue unless the tissues are tear tab connected. Mechanical folding rolls also require a high degree of maintenance. This invention attains a crease for separately cut interfolded tissues which was heretofore unattainable.

DETAILED DESCRIPTION

The present invention overcomes the complexity of prior art systems by providing a creasing structure which is substantially simpler and lower in cost than those in the prior art.

Figure 1:
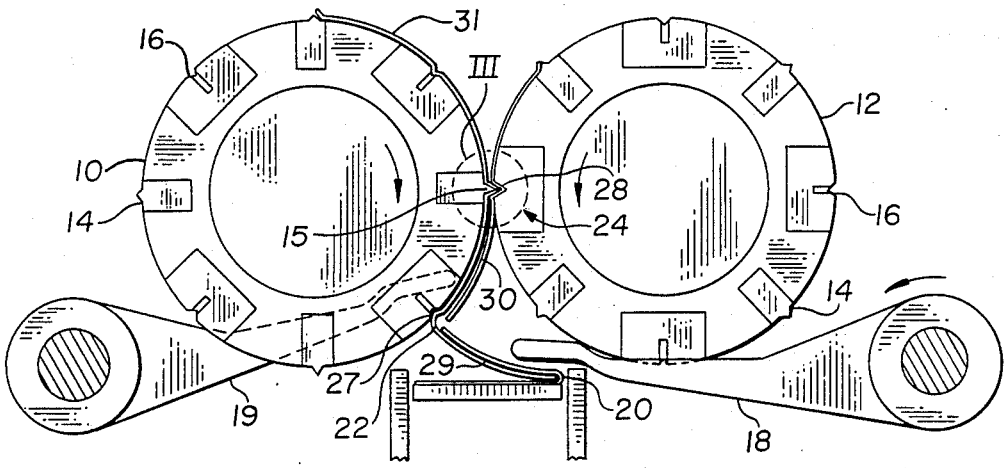
FIG. 1 discloses an interfolding and stacking mechanism which utilizes the improvement of the present invention.

Referring first to FIG. 1, the environment of the present invention may be seen to be a pair of folding rolls 10, 12 each having a plurality of projecting wedge-shaped protrusions 14 and a like number of mating recesses 16 and a pair of packer fingers 18, 19. In the interfolding process, folding rolls 10, 12 are timed or geared together such that each wedge 14 on one roll mates with a recess 16 on the other roll, with the process alternating between rolls. A plurality of paper sheets or other porous laminar products 29, 30, 31 are carried through the nip of folding rolls 10, 12 with the center of each sheet located at a recess 16 and the length of each sheet 30, 31 equal to a circumferential arc between successive protrusions 14 on a folding roll such that the beginning and end of each sheet is located at a wedge or protrusion 14.

Figure 2:
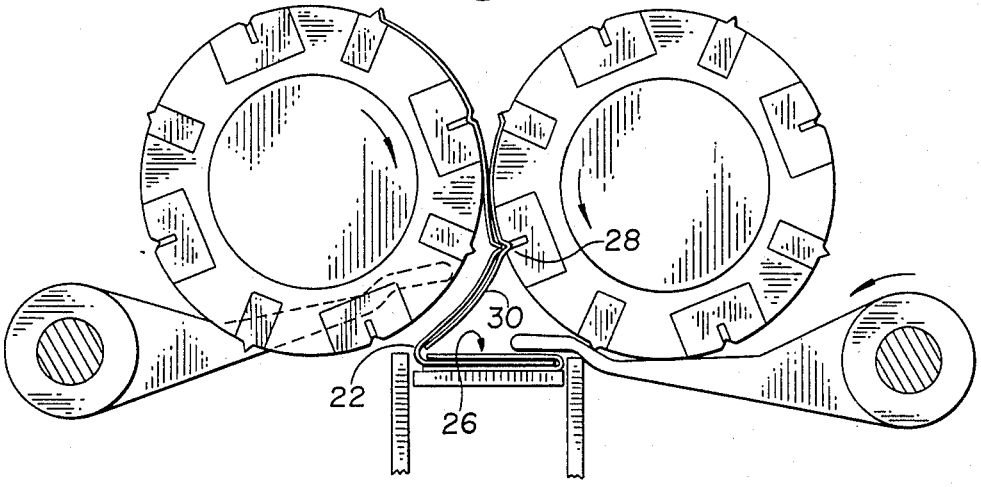
FIG. 2 shows the structure of FIG. 1 slightly advanced in position.

Preferably, packer finger 18 packs a released fold 20 while vacuum is maintained in recess 27 holding the next successive interfold 22, while creasing is taking place on sheet 30 in the nip 24 between folding rolls 10, 12. Once interfold 22 passes the point shown in FIG. 1, the vacuum is turned off in roll 10 allowing fold 22 to approach stack 26 as shown in FIG. 2. Vacuum is controlled in recess 28 leaving the nip in a similar fashion. It is to be understood that vacuum is maintained as a function of angular position on each roll 10, 12 from the time sheets are applied to the rolls 10, 12 up to the nip between rolls 10, 12. Vacuum is maintained in each recess passing the nip, but vacuum is shut off in roll 10 carrying protrusion 15 at the time that protrusion 15 passes the nip to transfer the leading edge of new sheet 31 and the trailing edge of prior sheet 29 from roll 10 to roll 12.

Figure 3:
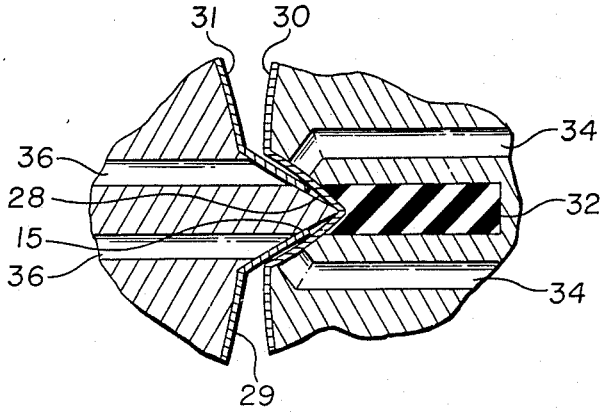
FIG. 3 is an enlarged view of region III of FIG. 1 showing details of the present invention.

Referring now to FIG. 3, an enlarged view of the nip region of FIG. 1 is shown. Wedge-shaped protrusion 15 deforms sheet 30 against an elastic anvil 32 in recess 28 forming a crease in sheet 30. Anvil 32 is preferably made of a resilient material such as an elastomer. Creasing sheet 30 in this manner aids in the interfolding and stacking process, resulting in an improved interfolded stack 26. Anvil 32 is preferably made of 90 shore a durometer polyurethane.

First vacuum ports 34 are present in recess 28, preferably on leading and trailing surfaces or sides of anvil 32 in roll 12. Second vacuum ports 36 are present on leading and trailing sides of wedge 15. In a similar manner vacuum porting is provided for at each protrusion 14 and recess 16 on rolls 10, 12.

The invention is not to be taken as limited to all of the details thereof as modifications and variations thereof may be made without departing from the spirit or scope of the invention; accordingly,

What is claimed is:

1. In a paper interfolding machine of the type having first and second folding rolls mounted adjacent each other for rotation about parallel axes with porous tissue paper carried by each of said rolls and a wedge-shaped protrusion on said first folding roll and a mating recess on said second folding roll for receiving said protrusion in a nip between said rolls, the improvement in combination therewith comprising:

(i) a resilient member filling at least a portion of said mating recess and forming an elastic anvil within said recess wherein said protrusion deforms said resilient member when said protrusion is received in said recess and creases a sheet of said paper received in the nip between said rolls by the action of said protrusion on said anvil, and (ii) vacuum port means on said second folding roll for selectively adhering said sheet to said second roll during said creasing.

2. The improvement of claim 1 wherein said resilient member is formed of elastomeric material.

3. The improvement of claim 1 wherein each of said folding rolls has alternating protrusions and recesses about its periphery such that said protrusions on one roll mate with said recesses on the other roll as said rolls rotate.

4. The improvement of claim 3 wherein said vacuum port means comprises vacuum openings on leading and trailing surfaces of each said recess.

5. The improvement of claim 3 wherein said vacuum port means comprises vacuum openings on leading and trailing sides of each said protrusion.

6. The improvement of claim 5 wherein vacuum is shut off from said protrusion at the time said protrusion passes the nip between said rolls such that sheets in the nip are transferred to the roll having a recess mating with said protrusion in the nip.

* * * * *